US005331605A

United States Patent [19]

Hagerty

[11] Patent Number: 5,331,605

[45] Date of Patent: Jul. 19, 1994

[54] REINFORCED FOAM CORE ACOUSTIC BAFFLE

[75] Inventor: James D. Hagerty, Tiverton, R.I.

[73] Assignee: The United States of America as represented by the Secretary of the Navy, Washington, D.C.

[21] Appl. No.: 121,010

[22] Filed: Sep. 14, 1993

[51] Int. Cl.[5] ..... H04R 1/28

[52] U.S. Cl. ..... 367/176

[58] Field of Search ..... 367/1, 162, 176; 181/284

[56] References Cited

U.S. PATENT DOCUMENTS

| | | | |
|---|---|---|---|
| 2,811,216 | 10/1957 | Harris | 181/284 |
| 4,669,573 | 6/1987 | Goodman | 181/286 |
| 4,975,799 | 12/1990 | McGee et al. | 367/176 |

*Primary Examiner*—Daniel T. Pihulic

*Attorney, Agent, or Firm*—Michael J. McGowan; Prithvi C. Lall; James M. Kasischke

[57] ABSTRACT

A reinforced foam core acoustic baffle includes a pressure-release polystyrene foam core, upper and lower steel reinforcing plates, a plurality of steel reinforcing rods, and a high-density foam skirt. The reinforcing plates are bonded to the upper and lower surfaces of the foam core, and the reinforcing rods are received through the core and are secured between the reinforcing plates so as to maintain the plates in spaced relation. The high-density foam skirt comprises a plurality of high-density foam panels which are bonded to the side surfaces of the foam core so as to overlap the upper and lower reinforcing plates. The foam panels are bonded with a watertight epoxy adhesive that forms a watertight seal with the reinforcing plates, and the foam panels further prevent the pressure-release foam from being crushed inwardly at the sides.

10 Claims, 1 Drawing Sheet

REINFORCED FOAM CORE ACOUSTIC BAFFLE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The instant invention relates to underwater acoustic sensor systems and more particularly to a reinforced foam core acoustic baffle for use at depths up to 1200 feet.

(2) Description of the Prior Art

It is well known in the art to provide underwater noise measurement, tracking and telemetry systems with acoustic baffles in order to reduce underwater background noise such as that caused by wave motion, wind, and electro-mechanical machinery on boats. In this regard, pressure-release foam baffles have heretofore been known in the art for use in shallow water acoustic sensor systems. Pressure-release foam is a low-density foam having a high content of air pockets and therefore it greatly dampens any sound pressure wave impinging on it. However, it has been found that pressure-release foam is not useful in depths greater than 300 feet because hydrostatic pressure crushes the foam. Denser foams are able to withstand greater pressure; however, they also have poorer acoustic baffling capabilities.

A deep water acoustic baffle is disclosed in the U.S. Pat. No. 4,975,799 to McGee et al. It comprises a one-inch thick sheet of fiber-metal which is enclosed in neoprene. While this baffle is highly stable at deep water pressures, the material in general is inferior to low-density pressure-release foam in its ability to provide acoustic baffling.

Also of interest is U.S. Pat. No. 4,669,573 to Goodman which discloses an underwater acoustic baffle enhancer. The '573 baffle enhancer comprises a stiffened resistive screen fixed in front of a compliant material. An irregular shaped material is provided on the other side of the screen to provide stiffness. The core of the baffle is suffused with water to prevent collapse of the baffle under large hydrostatic pressures.

Other acoustic baffles for use in depths of up to two thousand feet comprise laminated structures which include a rigid inner element sandwiched between two flexible outer sheets and surrounded around its edges with a waterproof seal to completely encapsulate the inner element. The inner element includes a plurality of evenly distributed air cavities which provide a low acoustic impedance compared to water. The inner element further maintains a constant separation between the flexible cover sheets, and therefore maintains a low acoustic impedance even under high hydrostatic pressures.

Although thee prior art structures can provide a low acoustic impedance at great depths, they are considered to be too costly and too heavy for use in current systems.

SUMMARY OF THE INVENTION

Accordingly, it is an object of the instant invention to provide an acoustic baffle which can be utilized in depths up to 1200 feet.

It is another object to provide an acoustic baffle which minimizes acoustic transmission.

A further object is to provide a low cost, light weight acoustic baffle.

These objects are accomplished in the present invention by providing a reinforced foam core acoustic baffle comprising a pressure-release polystyrene foam core, upper and lower steel reinforcing plates, a plurality of steel reinforcing rods and a high-density foam skirt. The reinforcing plates are bonded to the upper and lower surfaces of the foam core, and the reinforcing rods are received through the core and secured between the reinforcing plates so as to maintain the plates in spaced relation. The high-density foam skirt comprises a plurality of high-density foam panels which are bonded by a watertight epoxy to the side edges of the foam core so as to overlap the upper and lower reinforcing plates. When the acoustic baffle is submerged, the steel reinforcing system and the high-density foam skirt cooperate to prevent the foam core from being crushed by hydrostatic pressure.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
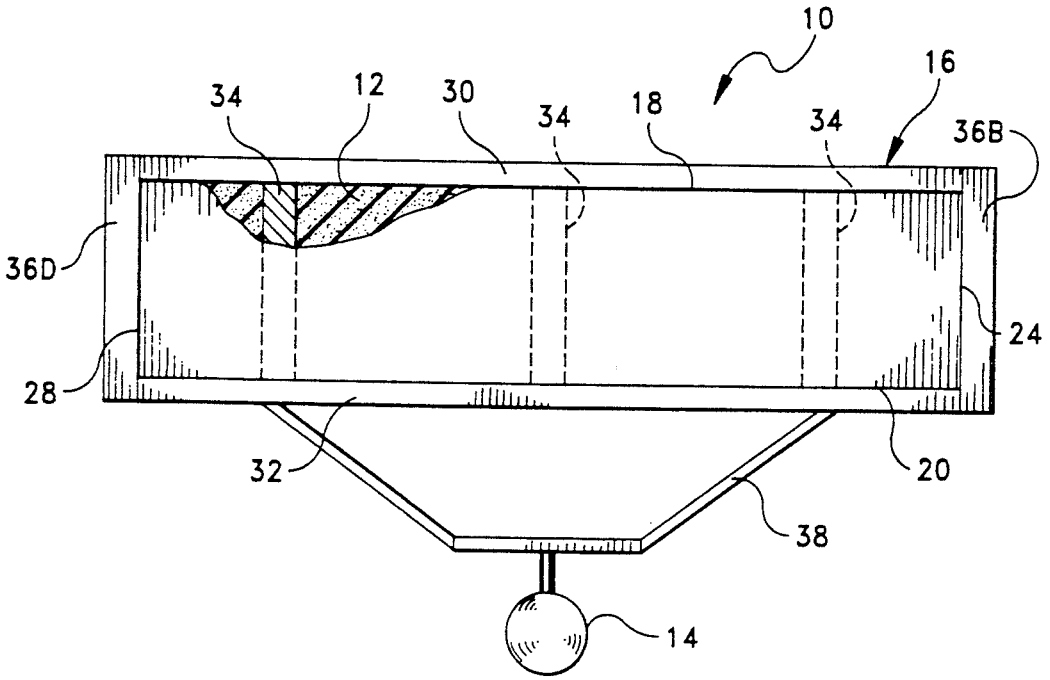
FIG. 1 is a side view, partially in cross-section, of the reinforced foam core acoustic baffle of the instant invention.
Figure 2:
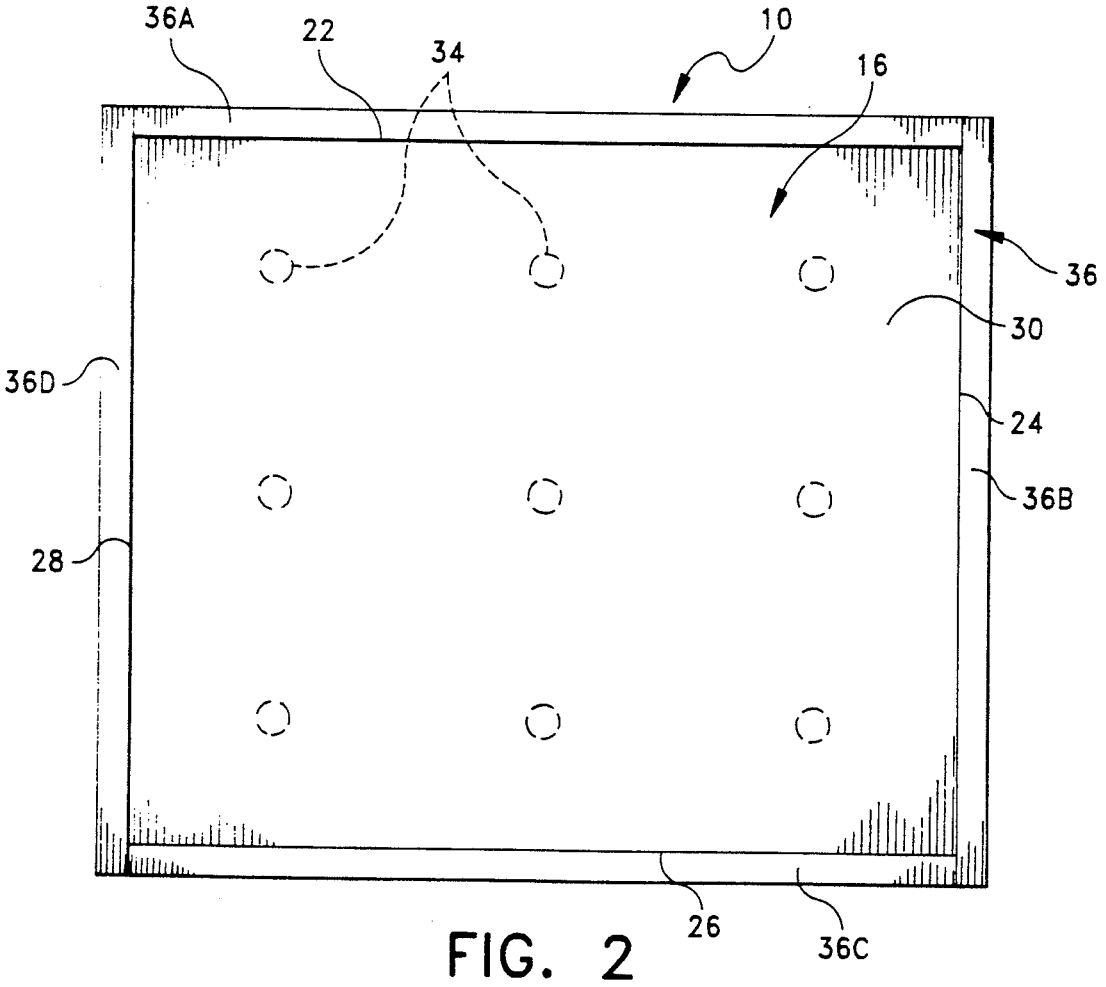
FIG. 2 is a top view thereof.

Referring now to the drawings, the reinforced foam core acoustic baffle of the instant invention is illustrated and generally indicated at 10 in FIGS. 1 and 2. As will hereinafter be more fully described, the instant acoustic baffle 10 comprises a foam core 12 which is operative for acoustically shielding an underwater hydrophone 14 from surface noise, and a reinforcing system generally indicated at 16 which enables foam core 12 to be submerged up to a depth of 1200 feet without crushing.

Foam core 12 preferably comprises a block of low-density pressure-release polystyrene foam with the best available acoustic damping properties. A foam similar to product No. MS-12 from Emerson & Cumings, Inc., or the like, is suitable for this purpose. Foam core 12 has substantially flat upper and lower surfaces 18 and 20 and four side edges 22, 24, 26 and 28. Foam core 12 can alternatively be circular or oval in shape without affecting the nature of the invention.

Reinforcing system 16 comprises first and second steel reinforcing plates 30 and 32 respectively, which are received on upper and lower surfaces 18 and 20 of foam core 12, a plurality of steel reinforcing rods 34 which are received through foam core 12 and secured, such as by welding or adhesive, between reinforcing plates 30 and 32, and a high-density foam skirt 36 which is secured around the four side edges 22, 24, 26 and 28 of foam core 12. Steel reinforcing plates 30 and 32 preferably have a thickness of 0.375 inches, and they are bonded to upper and lower surfaces 18 and 20 of foam core 12 with an epoxy adhesive so that the damping effect of foam core 12 keeps reinforcing plates 30 and 32 from "ringing". It is recommended that the faces of reinforcing plates 30 and 32 be sand-blasted and cleaned with alcohol before they are fastened to foam 12 with epoxy, as this will enhance the integrity of the bonding. It is pointed out that reinforcing plates 30 and 32 are essentially acoustically transparent underwater as long as their thickness is a small fraction of the sound wavelength; therefore, any sound waves incident to top plate 30 are transmitted directly into foam core 12. While steel is indicated as the preferred reinforcing material, other types of materials, both for reinforcing plates 30 and 32, and for reinforcing rods 34, can also be used depending on weight requirements of baffle 10 and the degree of noise transmission through baffle 10 which is acceptable.

Reinforcing rods 34 preferably have a diameter of 0.5–1.0 inches, and they are operative for maintaining reinforcing plates 30 and 32 in spaced relation so as to prevent foam core 12 from being crushed therebetween. (See FIG. 1). As illustrated in FIG. 2, there are preferably nine reinforcing rods 34 which are uniformly distributed about the surface area of the baffle 10. In general, the deformation of foam core 12 is a function of the water pressure, the distance between reinforcing rods 34, the moment of inertia of the cross-section of rods 34, and the Young's Modulus of both rods 34 and foam core 12. The deformation of foam core 12 is directly proportional to the water pressure and the distance between reinforcing rods 34. The deformation is inversely proportional to the moment of inertia of rod 34 cross-section, and inversely proportional to the Young's Modulus of rods 34 and foam 12. Using these relationships a minimum number of reinforcing rods 34, depending on the depth of use, can be determined in order to minimize the noise transmitted through baffle 10.

Skirt 36 preferably comprises four panels 36A, 36B, 36C, and 36D of high-density syntactic foam which are bonded with epoxy to side surfaces 22, 24, 26, and 28 of foam core 12 as illustrated in FIG. 2. It is pointed out that foam panels 36A, 36B, 36C, and 36D should overlap reinforcing plates 30 and 32. (See FIG. 1). In this embodiment, foam panels 36A, 36B, 36C, and 36D comprise a foam having a crush pressure of at least 3,000 p.s.i., and good baffling properties, such as EL-30A foam from Emerson & Cumings, Inc., or the like. Other materials that have the requisite acoustic and pressure tolerant properties can alternatively be used for the foam panels. This material results in less sound being transmitted through panels 36A, 36B, 36C and 36D from first reinforcing plate 30 to second reinforcing plate 32. Foam side panels 36A, 36B, 36C, and 36D are operative for withstanding several thousand p.s.i. to prevent side edges 22, 24, 26 and 28 of foam core 12 from caving in under high pressure. Side panels 36A, 36B, 36C and 36D are also operative for forming a watertight seal with first and second reinforcing plates 30 and 32. It is pointed out that the entire structure must be completely watertight, since leaks would allow water under high pressure to work its way into foam core 12, thereby breaking open internal air cavities and reducing baffling capability. Accordingly, an epoxy seal that wicks through to the surface at all joint interfaces is recommended to ensure that no gaps are present.

In use, one or more hydrophones 14 can be attached to second reinforcing plate 32 with any type of suitable fixture, such as a mounting assembly 38 as illustrated in FIG. 1. It can therefore be appreciated that surface noises which are incident to first reinforcing plate 30 are transmitted into foam core 12 in the middle of structure 10 and absorbed, thereby preventing the sound waves from continuing through baffle 10 to become incident on hydrophone 14.

It can therefore be seen that instant invention provides a unique hybrid construction for an acoustic baffle. The hybrid baffle 10 includes a low-density pressure-release foam core 12 for maximum baffling capability and a reinforcing system 16 which enables foam core 12 to be submerged to a depth of 1200 feet without crushing. It can also be appreciated that baffle 10 may be constructed at a fraction of the cost, size and weight of prior art baffle designs with a structure that is compact and easily maneuvered. For these reasons, it is believed that the instant invention represents a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An acoustic baffle comprising:

a low-density foam Slab having upper and lower substantially flat surfaces, and a perimetric side edge;

first and second rigid reinforcing plates bonded to said upper and lower surfaces of said foam slab;

a plurality of reinforcing rods extending through said foam slab, joined between said first and second reinforcing plates, and positioned so as to maintain said first and second reinforcing plates in spaced relation; and a skirt which is bonded to said perimetric edge of said foam slab so as to overlap the terminal edges of said first and second reinforcing plates.

2. In the acoustic baffle of claim 1, said skirt forming a watertight seal with said first and second reinforcing plates.

3. The acoustic baffle of claim 2 wherein said low-density foam is a pressure-release polystyrene foam.

4. The acoustic baffle of claim 2 wherein said perimetric side edge of said foam slab has a plurality of side surfaces, and said foam skirt comprises a plurality of foam panels which are bonded to said side surfaces, to said first and second reinforcing plates, and to each other thereby creating a watertight seal with said reinforcing plates.

5. The acoustic baffle of claim 4 wherein said foam panels comprise high-density foam panels.

6. The acoustic baffle of claim 5 further comprising at least one hydrophone attached to said second reinforcing plate.

7. In the acoustic baffle of claim 2, wherein said first and second reinforcing plates are steel plates.

8. In the acoustic baffle of claim 7, wherein said reinforcing rods are steel rods.

9. The acoustic baffle of claim 8 further comprising at least one hydrophone attached to said second reinforcing plate.

10. The acoustic baffle of claim 2 further comprising at least one hydrophone attached to said second reinforcing plate.

* * * * *